United States Patent [19]

Fidi et al.

[11] 4,071,717

[45] Jan. 31, 1978

[54] HEADPHONE EARPIECE

[75] Inventors: Werner Fidi, Baden; Horst Moser, Vienna, both of Austria

[73] Assignee: AKG Akustische u. Kino-Gerate Gesellschaft m.b.H., Austria

[21] Appl. No.: 674,090

[22] Filed: Apr. 6, 1976

[30] Foreign Application Priority Data

Apr. 8, 1975 Austria ..... 2643/75

[51] Int. Cl.[2] ..... H04R 1/10

[52] U.S. Cl. ..... 179/182 R; 181/129

[58] Field of Search ..... 179/156 R, 182 R, 180; 181/129, 151, 166

[56] References Cited

U.S. PATENT DOCUMENTS 3,112,005 11/1963 Shaw et al. ..... 179/182 R X

*Primary Examiner*—William C. Cooper

*Attorney, Agent, or Firm*—McGlew and Tuttle

[57] ABSTRACT

A headphone earpiece for wearing on a person's ear, comprises an annular pad adapted to engage around the ear and a sound transducer having a transducer diaphragm supported within said pad so as to define a coupling space between the transducer diaphragm and the person's ear. The support means includes a rigid plate between the diaphragm and the pad which has frictional resistances distributed thereover and which may advantageously comprise the material of the plate itself or a plurality of openings or holes having acoustic frictional resistance elements therebehind or positioned in the holes. The rear portion of the support means includes a cap having perforations which covers the back portion of the transducer.

14 Claims, 7 Drawing Figures

HEADPHONE EARPIECE

FIELD AND BACKGROUND OF THE INVENTION

This invention relates in general to the construction of headphone earpieces and, in particular, to a new and useful headphone earpiece which comprises an annular pad which defines a coupling space between the ear entrance and a transducer diaphragm, and which is provided with frictional resistances.

DESCRIPTION OF THE PRIOR ART

With headphones which have a coupling space between the ear entrance and a transducer diaphragm which is surrounded by an annular pad, a phenomenon is frequently experienced which is designated as an "in-the-head localization" which means that the impression is created that the sound source is located near, and in particular behind, the head. This is due to the fact that in the earphones, the sound path for the transducer diaphragm up to the eardrum is of a determining importance for the production of an acoustic event. Various solutions have been provided for coupling the electroacoustic transducer to the ear. However, no satisfactory solution can be found among the known provisions so that, up to date, no headphone is known with which the directional and range hearing in the stereophonic transmission technique comes close to natural hearing.

Tests have shown that very small deviations from the acoustic processes of the stereophonic transmission lead to disturbances in the perception of the acoustic event. Therefore, all possible measures must be taken to prevent distortions of the amplitude, the phase frequency characteristic, and the group delay. Since natural hearing is influenced by the external ear in the headphone, the function of the article should also be maintained as far as possible. In particular, in a headphone comprising an ear pad surrounding the ear, the acoustical process taking place in the coupling space is to be looked at as undulatory phenomena in acoustic lines.

The present invention is directed to the elimination of disturbances which impair the reception or perception of an acoustic event, particularly in headphones comprising an ear pad which in use surrounds the ear. Such disturbances which are caused substantially by resonance effects in the coupling space are furthered by the fact that, as a rule, the surface area of the transducer diaphragm is substantially smaller than the surface area of the auricle so that relatively large surfaces are present within the earpiece which reflect the sound instead of destroying it. Inserts of absorbing material may lead to an improvement, but this cannot solve the problem of ensuring an auditory sensation true to nature of a stereophonically transmitted acoustic event in a satisfactory manner.

SUMMARY OF THE INVENTION

In accordance with the present invention, a substantial improvement can be obtained, particularly in respect to headphones which have a transducer diaphragm supported within an annular earpad. In accordance with the invention, that surface in the earpiece which extends between the transducer diaphragm and the surrounding annular pad is formed by a rigid plate on which the electroacoustic transducer is supported and which is either designed itself as an acoustical frictional resistance or is provided with frictional resistances in the form of apertures, bores, or the like, distributed over the entire surface. With such a construction, the use of such a headphone produces a sound-absorbing frictional resistance which is placed opposite the auricle and this resistance extends from the transducer diaphragm up to the annular earpad and has a surface area which is a multiple of the surface area of the diaphragm. The result of this construction is that no resonance effects can occur in the coupling space and the transmitting function of the auricle remains preserved so that the finally obtained effect is similar to the stereophonic hearing.

In a first embodiment of the invention, the rigid plate supporting the electroacoustic transducer is provided with a plurality of large surface, acoustic frictional resistances which are arranged approximately circularly about the transducer.

In another embodiment, the rigid plate supporting the transducer is provided with a plurality of small, narrow bores, each representing and acting as a frictional resistance. Advantageously, in addition, the bores may be covered on one or both sides with a damping material, for example, in the form of an annular disc of felt, nonwoven fabric, filter paper, or the like. The damping material might also be received directly in the bores. This may be done in a particularly simple manner by injecting a plastic having the desired acoustic properties. A very practical solution is obtained by designing the rigid plate itself as a frictional resistance and this may be done by using a sintered material, such as a sintered plastic, for example.

The acoustic frictional resistance which is substantially distributed over the entire surface area of the rigid plate may be distributed nonuniformly, preferably in the radial direction or the resistance may be distributed uniformly, if desired.

In order to effectively repress diaphragm resonances in the higher frequency ranges, it has proved advantageous to design the acoustic frictional resistances which are provided in the rigid plate so that they comprise an acoustic mass or material which is effective in such high frequency ranges. In this case, the successful result obtained with the invention is not only an improvement of the stereophonic reproduction of the acoustic events, but also a notable linearization of the frequency response.

Accordingly, it is an object of the invention to provide a headphone earpiece for wearing on a person's ear which includes an annular pad adapted to engage around the ear and a sound transducer having a transducer diaphragm located within the pad and carried by support means which includes a rigid plate having frictional resistances distributed between the transducer diaphragm and said pad.

A further object of the invention is to provide a headphone earpiece which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there are illustrated preferred embodiments of the invention.

DESCRIPTION OF THE PREFERRED EMBODIMENTS

Figure 1:
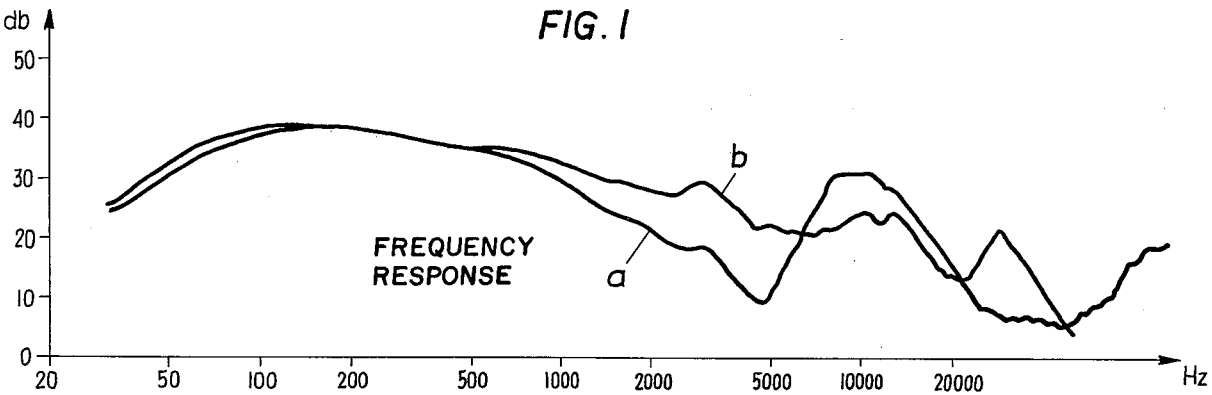
FIG. 1 is a curve showing frequency response characteristics of a conventional headphone with a tightly fitting earpad for two different pad diameters.
Figure 2:
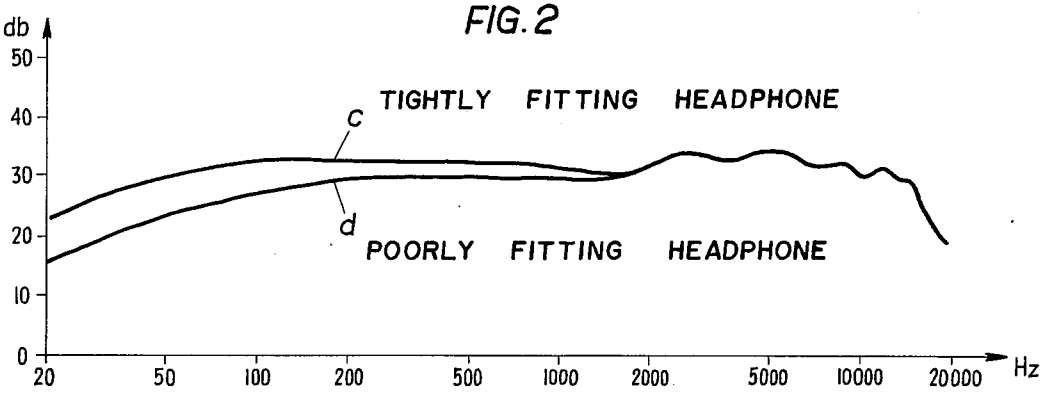
FIG. 2 is a curve showing the sound pressure frequency characteristic at the ear of a headphone constructed in accordance with the invention for a tightly fitting earpad and for a poorly fitted earpad.

Referring to the drawings in particular, in FIG. 1, there is indicated a frequency response characteristic curve which includes a curve *a* which applies to a closed earphone comprising an annular pad surrounding the ear. The dip near 5kHz is characteristic of the earpiece of such a headphone and due to interference effects in the coupling space. With a diminished coupling space, for example, by means of a smaller earpad or an annular insert, the interference effects are reduced. However, the overall shape of the frequency response curve remains unsatisfactory. Far more favorable is a frequency characteristic of a headphone earpiece designed in accordance with the invention, as shown in respect to FIG. 2. The curve *c* is obtained with a tightly fitting headphone, while the curve *d* corresponds to a poorly fitting headphone. In this latter case, as may be seen, an attenuation of some db occurs only at the low frequencies. The general characteristic of the curve, however, remains substantially unchanged. In addition, aside from the more favorable frequency characteristic, a better stereophonic reproduction of the transmitted acoustic events, with a more spatial effect, is obtained, because the linear distortions through the auricle occurring during the stereophonic reception are not disturbed by resonances otherwise produced in a closed coupling chamber. Since even small deflections of the signals received by the ear affect the directional and range hearing, the application of the invention results in a substantial progress in the transmitting function of the headphone.

Figure 3:
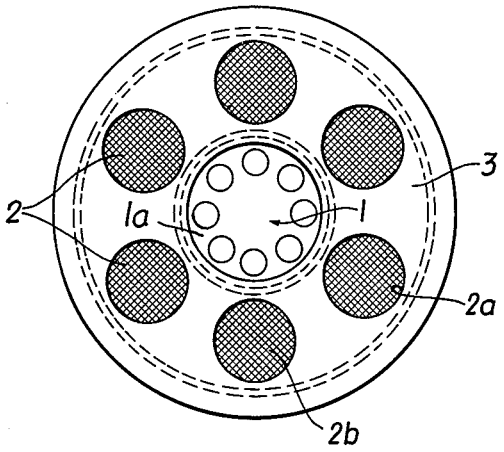
FIG. 3 is a top view of a support plate and transducer for a headphone earpiece constructed in accordance with the invention.
Figure 4:
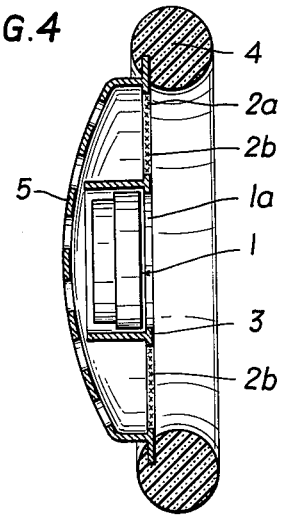
FIG. 4 is a sectional view of the earpiece with the annular earpad in place.

In accordance with the invention, a headphone earpiece as shown in FIGS. 3 and 4 includes a transducer 1, having a diaphragm 1*a* which furnishes the acoustic power component. The transducer 1 is centered in respect to an annular earpad 4 made of a soft plastic such as foam. It is supported by support means which includes a substantially rigid plate or ring member 3 which has frictional resistances 2 associated therewith. In the embodiment of FIGS. 3 and 4, the resistances 2 are formed by openings or holes 2*a* formed in plate 3 and also by a frictional resistance area 2*b* which is formed, for example, by a frictional resistance element or layer which is positioned either in the openings 2*a* or behind them. The total surface area of the frictional resistances 2 is substantially larger than the total area of the transducer diaphragm 1*a*.

Transducer 1 is advantageously provided with sound outlets at its rear side for reducing the restoring force on the diaphragm 1*a*. The transducer 1 and the acoustic frictional resistance 2 are covered at the rear side by a protective cap 5 which is permeable to sound.

Figure 5:
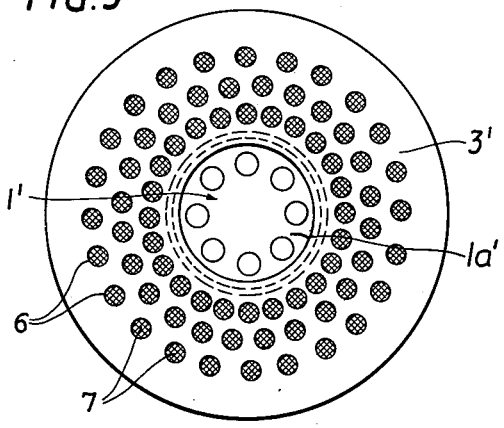
FIG. 5 is a view similar to FIG. 3 of another embodiment of the invention.
Figure 6:
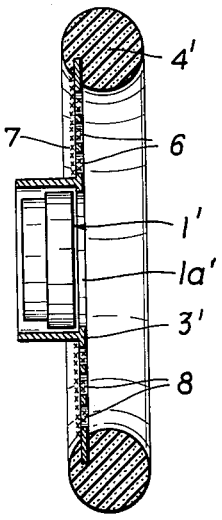
FIG. 6 is a sectional view of the embodiment shown in FIG. 5.

In the embodiment shown in FIGS. 5 and 6, the headphone earpiece includes an annular pad 4′ which surrounds the ear and a transducer 1′ which is supported within the annular earpad 4′ by support means which includes a rigid plate 3′ which has a multiplicity of holes or openings 6 therethrough which are covered on the inner side by acoustic frictional resistance elements 7. In addition, frictional resistance elements or bodies 8 are also received in the holes 6. Such bodies 8 may comprise an injection of a plastic material, for example. The pad and the support means hold the transducer 1 so that there is a coupling space between the entrance of the wearer's ear and the transducer diaphragm 1*a*′.

Figure 7:
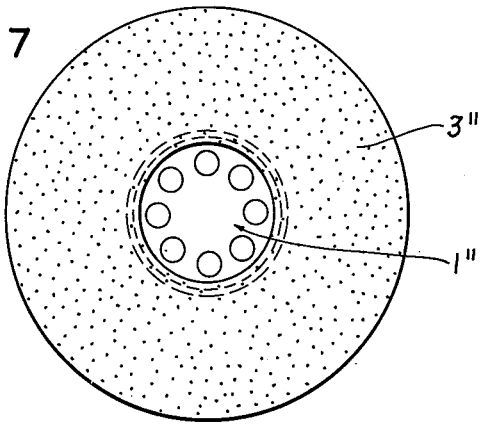
FIG. 7 is a view similar to FIG. 1 of still another embodiment of the invention.

In the embodiment shown in FIG. 7, the support means for a transducer 1″ comprises a rigid plate 3″ which is formed of a plastic sintered material which, by itself, comprises an acoustic resistance. The acoustic resistance per unit of surface is substantial for influencing the frequency response characteristic of the earphone. The resistance may be formed by a type of sintered material other than plastic, and it may be distributed uniformly over the entire surface or arranged in steps in the radial direction in order to obtain particular effects, etc.

The acoustic mass or material comprised in each acoustic resistance element in the embodiments of FIGS. 3 to 7 may be used for influencing the frequency response particularly in the range of high frequencies. With the inventive arrangement, the coupling space is damped to an extent such that no interference effects or resonances occur. Because the auricle is accommodated in a resonance-free space, its influence on the perception favorably affecting natural hearing is maintained. The acoustic event is perceived without disturbance so that a close to natural sensation is obtained. The invention is also usable for the quadrophonic reception. In such a case, advantageously, two transducers are horizontally juxtaposed and spaced from each other, and surrounded by acoustic frictional resistances which, in practice, will fill up the rigid plate.

While specific embodiments of the invention have been shown and described in detail to illustrate the application of the principles of the invention, it will be understood that the invention may be embodied otherwise without departing from such principles.

What is claimed is:

1. A headphone earpiece for engagement over a person's ear, comprising a sound permeable rigid plate forming an earpiece surface having a central opening therethrough, an electroacoustic transducer located adjacent said plate and supported within the opening by said plate, and an annular resilient pad surrounding and connected to the periphery of said plate, said plate having an acoustic frictional resistance which comprises a mass of acoustic material which is effective particularly in the range of high frequencies.

2. A headphone earpiece for engagement over a person's ear, comprising a rigid plate forming an earpiece surface having an opening therethrough, an electroacoustic transducer located adjacent said plate and supported within the opening thereof, and an annular resilient pad surrounding and connected to the periphery of said plate, said plate being sound permeable and having an acoustic frictional resistance, said rigid plate having one ear facing surface and an opposite surface which is open to the atmosphere.

3. A headphone earpiece according to claim 2, wherein said acoustic frictional resistance includes a plurality of bores extending through said rigid plate and defining individual frictional resistances.

4. A headphone earpiece according to claim 2, wherein said acoustic frictional resistance comprises a plurality of large surface acoustical frictional resistances formed around said transducer diaphragm.

5. A headphone earpiece according to claim 2, wherein said acoustic frictional resistance comprises at least one opening through said rigid plate and an acoustic damping material located extending across said opening.

6. A headphone earpiece according to claim 2, wherein said acoustic frictional resistance comprises a plurality of small openings arranged around the circumference of said transducer diaphragm in said rigid plate, and an injection of plastic materials in each of the bores having acoustic properties.

7. A headphone earpiece according to claim 2, wherein said acoustic frictional resistance comprises said rigid plate.

8. A headphone earpiece according to claim 7, wherein said rigid plate comprises a sintered plastic.

9. A headphone earpiece according to claim 2, wherein said rigid plate acoustic frictional resistance is such that the acoustic resistance per unit of surface is constant over the entire area.

10. A headphone earpiece according to claim 2, wherein said acoustic frictional resistance is distributed non-uniformly in the radial direction over said rigid plate.

11. A headphone earpiece according to claim 2, wherein said acoustic frictional resistance comprises a mass of acoustic material which is effective particularly in the range of high frequencies.

12. A headphone earpiece for engagement over a person's ear comprising a sound permeable rigid plate forming an earpiece surface having an opening therethrough, an electro-acoustic transducer located adjacent said plate and supported within the opening thereof, and an annular resilient pad surrounding and connected to the periphery of said plate, said plate having an acoustic frictional resistance distributed non-uniformly in the radial direction over said plate.

13. A headphone earpiece for engagement over a person's ear comprising a rigid plate forming an earpiece surface having a central opening therethrough, an electroacoustic transducer located adjacent said plate and supported by said plate within the opening thereof, and an annular resilient pad surrounding and connected to the periphery of said plate, said plate comprising a sound permeable sintered plastic material providing an acoustic frictional resistance.

14. A headphone earpiece for engagement over a person's ear, comprising a rigid sound permeable plate forming an earpiece surface having an opening therethrough, an electroacoustic transducer located adjacent said plate and supported within the opening thereof, and an annular resilient pad surrounding and connected to the periphery of said plate, said plate having an acoustic frictional resistance such that the acoustic resistance per unit of surface is constant over the entire area.

* * * * *